US008327593B2

(12) United States Patent
Laprise

(10) Patent No.: US 8,327,593 B2
(45) Date of Patent: Dec. 11, 2012

(54) INSULATED WALL

(75) Inventor: Daniel Laprise, Montmagny (CA)

(73) Assignee: Maisons Laprise Inc., Montmagny, QC (CA)

( * ) Notice: Subject to any disclaimer, the term of this patent is extended or adjusted under 35 U.S.C. 154(b) by 0 days.

(21) Appl. No.: 13/044,622

(22) Filed: Mar. 10, 2011

(65) Prior Publication Data

US 2011/0154765 A1 Jun. 30, 2011

Related U.S. Application Data

(63) Continuation of application No. 12/593,591, filed as application No. PCT/CA2007/000511 on Mar. 28, 2007, now abandoned.

(51) Int. Cl.
*E04C 1/00* (2006.01)

(52) U.S. Cl. ..... 52/309.7; 52/309.2; 52/309.16; 52/284; 52/592.1

(58) Field of Classification Search ..... 52/309.2, 52/309.7, 309.16, 281, 282.1, 284, 285.1, 52/592.1

See application file for complete search history.

(56) References Cited

U.S. PATENT DOCUMENTS

| | | | | |
|---|---|---|---|---|
| 3,535,844 | A | 10/1970 | Glaros | |
| 3,564,800 | A * | 2/1971 | Armitage | 52/394 |
| 3,823,525 | A * | 7/1974 | Bruun | 52/309.2 |
| 3,927,498 | A * | 12/1975 | Benedetti | 52/79.1 |
| 4,104,840 | A | 8/1978 | Heintz et al. | |
| 4,107,891 | A * | 8/1978 | Cotton et al. | 52/394 |
| 4,152,873 | A | 5/1979 | Burke | |
| 4,435,934 | A * | 3/1984 | Kim | 52/309.7 |
| 4,443,988 | A * | 4/1984 | Coutu, Sr. | 52/309.9 |
| 4,517,782 | A * | 5/1985 | Shamszadeh | 52/309.7 |
| 4,633,634 | A | 1/1987 | Nemmer et al. | |
| 4,674,253 | A * | 6/1987 | Young | 52/404.2 |
| 4,720,948 | A | 1/1988 | Henley et al. | |
| 4,774,119 | A * | 9/1988 | Imhoff | 428/71 |
| 5,003,742 | A * | 4/1991 | Dettbarn | 52/282.3 |
| 5,067,296 | A * | 11/1991 | Brown et al. | 52/309.7 |
| 5,313,751 | A * | 5/1994 | Wittler | 52/238.1 |
| 5,349,796 | A | 9/1994 | Meyerson | |
| 5,373,678 | A * | 12/1994 | Hesser | 52/592.1 |
| 5,404,687 | A * | 4/1995 | Blake et al. | 52/600 |
| 5,497,589 | A | 3/1996 | Porter | |
| 5,509,242 | A * | 4/1996 | Rechsteiner et al. | 52/270 |
| 5,636,489 | A * | 6/1997 | Leverrier et al. | 52/540 |

(Continued)

FOREIGN PATENT DOCUMENTS

CA 2077797 3/1994

OTHER PUBLICATIONS

PCT International Search Report and Written Opinion of the International Searching authority for PCT/CA2007/000511 (Dec. 28, 2007).

(Continued)

*Primary Examiner* — Brian Glessner
*Assistant Examiner* — Joshua Ihezie
(74) *Attorney, Agent, or Firm* — Norton Rose Canada LLP

(57) ABSTRACT

A section of the wall has a plurality of interspaced structural members mounted between an upper frame member and a lower frame member, and insulating material generally filling the space between the structural members and upper and lower frame members.

9 Claims, 9 Drawing Sheets

U.S. PATENT DOCUMENTS

| | | | | |
|---|---|---|---|---|
| 5,638,651 | A | 6/1997 | Ford | |
| 5,701,708 | A * | 12/1997 | Taraba et al. | 52/309.9 |
| 5,822,940 | A * | 10/1998 | Carlin et al. | 52/479 |
| 5,829,215 | A * | 11/1998 | Billing | 52/309.4 |
| 6,145,257 | A * | 11/2000 | Cappuccio | 52/220.2 |
| 6,155,014 | A * | 12/2000 | Wagner | 52/281 |
| 6,481,172 | B1 * | 11/2002 | Porter | 52/506.01 |
| 6,564,521 | B1 * | 5/2003 | Brown et al. | 52/309.11 |
| 6,945,001 | B1 * | 9/2005 | Suzuki | 52/582.1 |
| 7,107,731 | B2 * | 9/2006 | Record | 52/309.9 |
| 7,543,419 | B2 * | 6/2009 | Rue | 52/630 |
| 2003/0056456 | A1 * | 3/2003 | Heydon | 52/415 |
| 2005/0193676 | A1 | 9/2005 | Palmersten | |
| 2007/0039275 | A1 * | 2/2007 | Boyer | 52/592.1 |
| 2007/0294974 | A1 * | 12/2007 | Tonyan et al. | 52/481.1 |

OTHER PUBLICATIONS

Declaration of Jacques D'Amours.

* cited by examiner

INSULATED WALL

FIELD

The present improvements generally relate to the field of building construction, and more particularly to insulated walls of buildings.

BACKGROUND

In the construction industry, it is known to build walls by installing factory-made insulated wall sections on the construction site. The wall sections typically include a plurality of vertically extending structural members, or wall studs, an upper frame member, or wall plate, and a lower frame member, or sill. The space between the structural members and frame members being filled with an insulating material.

It is also known that providing an high degree of thermal insulation and reducing air infiltration is desirable both in cold climates, to reduce the amount of energy required in heating, and in warm climates, to reduce the amount of energy required in air-conditioning. In highly insulated homes, fresh air is provided via an air exchanger in which cold air from outside is heated with exiting hot air from inside, or vice-versa, to reduce the amount of energy requirement associated with mass transfer. With the increasing awareness of the population concerning energy economy, the increasing costs of energy, and the evolution of insulation technology, these long standing principles have taken an increasing importance in today's construction industry. Many countries, states or provinces have devised norms that specify minimal insulation requirements of building components such as insulated walls. An example of such a norm is the Novoclimat norm of the Agence de l'efficacité énergétique in Quebec, a province of Canada.

While known thermally insulated wall panels have been satisfactory to a certain degree, there is still a need to provide improvements, including improvements to further increase the insulation capacity, or thermal resistance of insulated walls. It is also desired to enhance the ease of assembly, and/or to lower manufacturing costs of insulated wall panels. Walls having increased insulation can typically reduce the amount of energy used in heating a building in winter by reducing energy losses through the walls, or reduce the amount of energy used in air-conditioning during the summer. Easing assembly and lowering manufacturing costs can result in achieving a lower overall initial cost for the building.

SUMMARY

In accordance with one aspect, there is provided an insulated wall panel having a front face, a back face, and two opposite mating sides, each mating side being shaped to mate with the opposite mating side of an other insulated wall panel for mating assembly in a wall section, the insulated wall panel comprising a structural member extending along one of the mating sides and being offset from the front face, and a self-supporting body of insulating material having a structural member covering extension on the front face to form a continuous facing layer of insulating material covering the structural members when two or more adjacent wall panels are matingly adjoined into a wall section.

In accordance with an other aspect, there is provided a wall section comprising: a plurality of adjacent insulated wall panels, each wall panel having a front face, a back face, two opposite mating sides, a structural member, having an upper end and a lower end, extending along one of the mating sides, offset from the front face, and a body of insulating material having a structural member covering extension on the front face, the insulated wall panels being aligned side by side with a mating side of each wall panel engaged with a corresponding mating side of an adjacent one of the wall panels and the structural member covering extensions covering the structural members in a continuous facing layer of insulating material, and an upper frame member secured to the upper end of each structural member and a lower frame member secured to the lower end of each structural member.

In accordance with an other aspect, there is provided a wall comprising at least two adjacent insulated wall panels, each insulated wall panel having a body made of a self-supporting insulating material, having a front face, a back face, and a mating side abutting against a mating side of an adjacent one of the insulated wall panels, with a structural member spacing therebetween, and a structural member offset from the front face filling the structural member spacing between the at least two insulated wall panels and covered by a portion of the body on the front face.

In accordance with an other aspect, there is provided a wall section comprising a plurality of interspaced structural members mounted between an upper frame member and a lower frame member, and insulating material generally filling the space between the structural members and upper and lower frame members, the wall section being characterized in that a layer of insulating material covers the structural members on a front face of the wall section.

DESCRIPTION OF THE FIGURES

Further features and advantages of the present improvements will become apparent from the following detailed description, taken in combination with the appended figures, in which.

DETAILED DESCRIPTION

Figure 1:
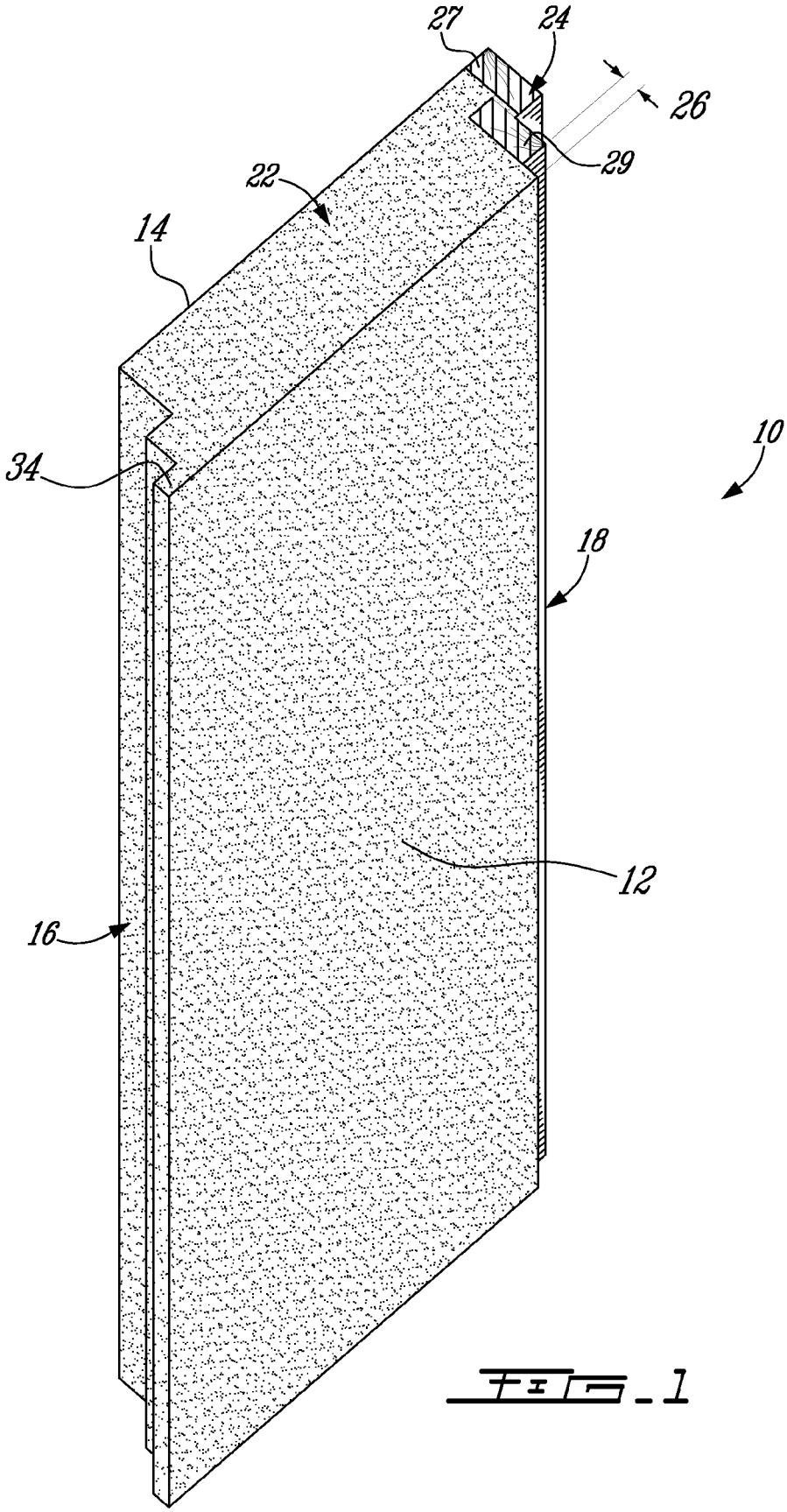
FIG. 1 is an isometric view of a first embodiment of an insulated wall panel where the structural member has two wood boards.

FIG. 1 shows a first example of an improved insulated wall panel 10. The insulated wall panel can generally be said to have a front face 12, a back face 14, and two opposite mating sides 16, 18. Each one of the mating sides 16, 18 is irregularly shaped to mate with the opposite mating side of an other insulated wall panel and the insulated wall panel 10 is thus designed to be assembled, or adjoined, with other insulated wall panels side by side. The irregular shape of the mating sides 16, 18 is advantageous in comparison with flat sides because flat sides can have an increased likelihood of presenting a gap extending through assembled wall panels, thus lowering the overall thermal resistance of a wall. However, flat mating sides can nevertheless be useful in certain applications.

The insulated wall panel 10 generally has a body 22 and a structural member 24. The body 22 represents the greatest portion of the insulated wall panel 10. A body 22 made of a self-supporting insulating material having satisfactory insulating characteristics can be used. In the illustrated example, Type 1 polystyrene is used, but other insulating materials can also be used such as polyisocyanurate, polyurethane, or mineral wool. A structural member 24 extends along one side 18 of the body 22. The structural member 24 is offset relative to the plane of the front face 12 of the insulated wall panel 10, i.e. it is separated therefrom by an insulation spacing 26. In this case, the structural member 24 advantageously includes two structural columns 27, 29 in an overlapping staggered configuration. Having a structural member 24 in two structural columns 27, 29, typically results in heat being conducted more poorly through the structural member 24 due to the discontinuity, and can thus yield a greater thermal resistance.

Figure 2:
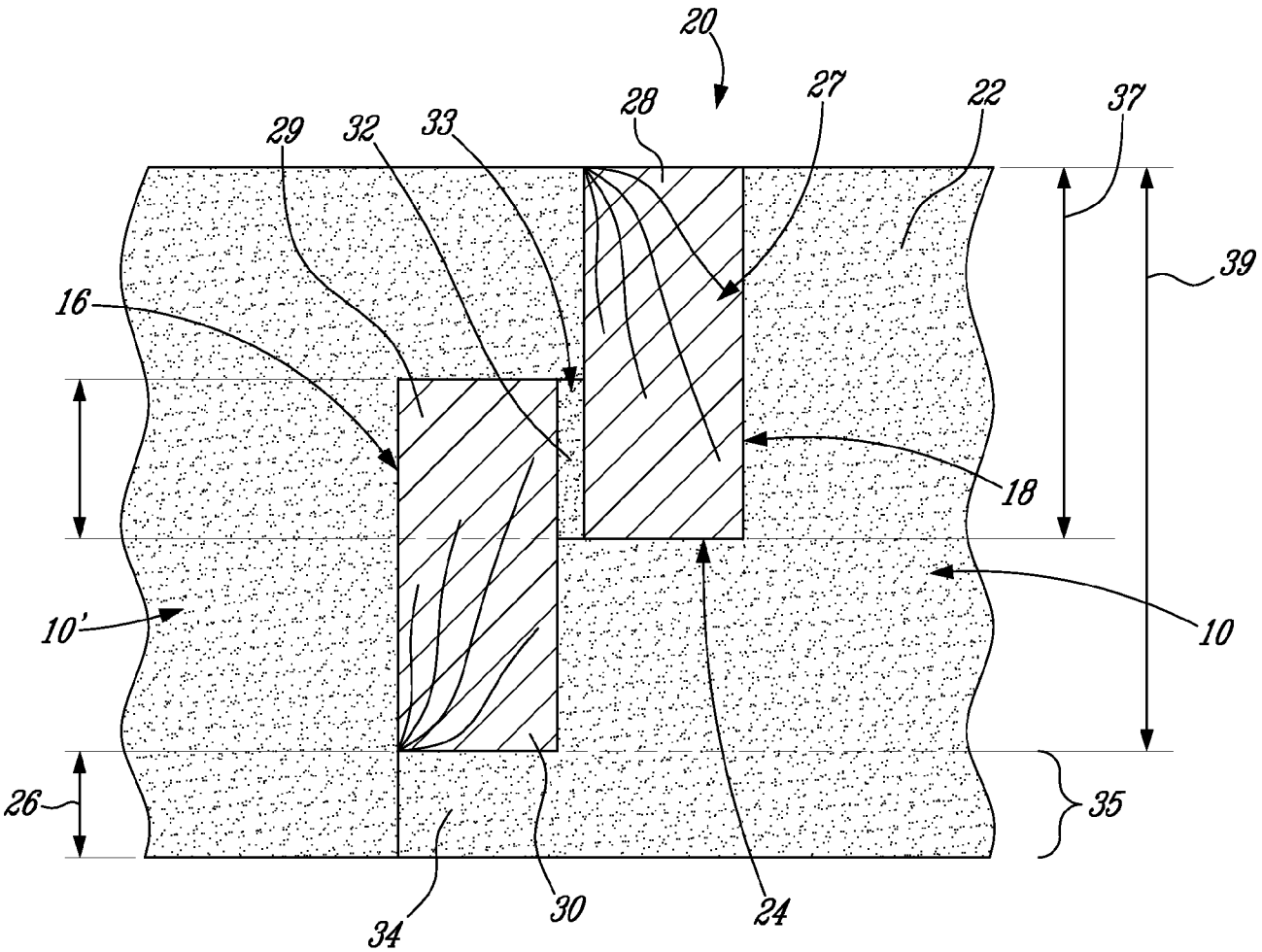
FIG. 2 is a top plan view, fragmented, showing two wall panels from FIG. 1 adjoined side by side.

In FIG. 2, two insulated wall panels 10, 10' are shown assembled to form a wall 20, and opposite the mating sides 16, 18 of the two insulated wall panels 10, 10' are shown engaged with one another. It has been found advantageous to provide the two structural columns 27, 29 in an overlapping staggered configuration, i.e. laterally offset and overlapping, rather than in an end-to-end configuration. In the illustrated example, the two structural columns overlap along an overlap distance 31. In the illustrated embodiment, the structural columns 27, 29 shown are 2×4 wood boards 28, 30 having a depth 37 of 8.9 cm (3.5 inches) each, and an overlap distance 31 of 3.8 cm (1.5 inches), for a total depth 39 of 13.97 cm (5.5 inches) for the structural member 24. Increasing the overlap distance can result in providing a thinner wall, thus reducing the overall insulation, whereas reducing the overlap distance can increase the probability of a gap being present between the two wood boards 28, 30. This specified configuration is also advantageous because it makes use of standard building materials.

The two structural columns 27, 29 can advantageously be separated by a thermal separator 33 which further impedes heat transfer by conduction between the two structural columns 27, 29. In the example, the thermal separator 33 extends on the complete overlap distance 31, along the full height of the structural columns, 27, 29. In this case, the thermal separator 33 is a layer of insulating material 32 which can be provided either as part of the body 22, or as a separate component.

The body 22 also includes a structural member covering extension 34 which occupies the depth of the insulation spacing 26. Thereby, when two or more wall panels 10, 10' are adjoined, a continuous facing 35 of insulating material is provided, covering the structural member 24. This increases the thermal resistance of a wall when compared to a wall in which the structural members are not covered by insulating material.

The thickness 26 of the structural member covering extension 34, or the difference between the thickness of the insulating body 22 and the depth occupied by the structural member 24 influences the amount of thermal insulation added to a resulting wall by the continuous facing 35 of insulating material. For illustrative purposes, adding a continuous facing 35 of insulating material of 2.5 cm (one inch) can yield an additional R 3.7 of insulation to the wall. The continuous facing 35 can advantageously be provided on the outside, or front face, of the wall panels, but it can alternately be provided on the inside, or back face as well.

Figure 3:
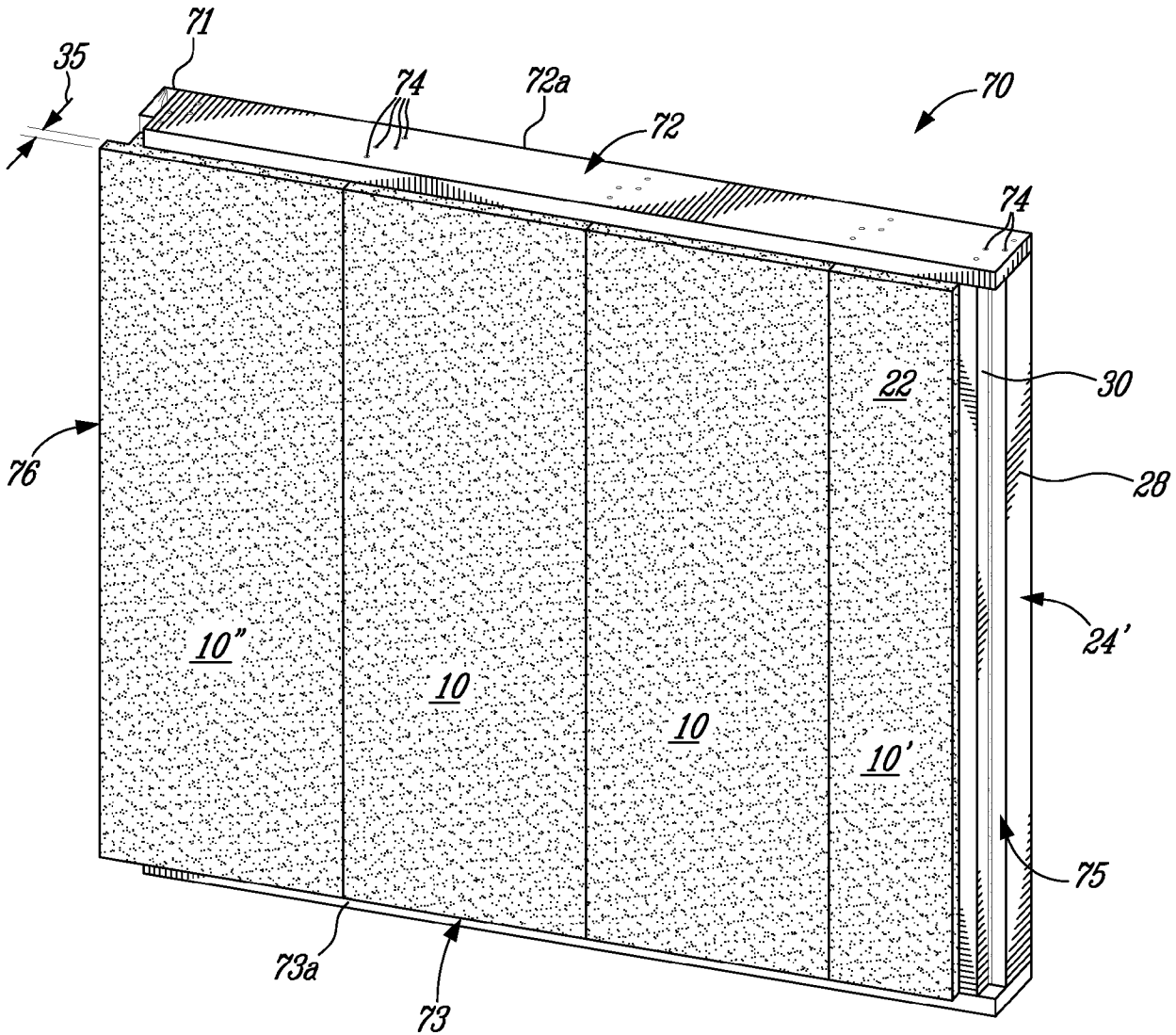
FIG. 3 is an example of a wall section incorporating several ones of the wall panel of FIG. 1.

FIG. 3 shows a wall section 70 having a plurality of the wall panels 10, 10', 10" matingly adjoined side by side between an upper frame member 72 and a lower frame member 73. A plurality of such wall sections can be factory-assembled with independent and specific design criteria corresponding to a particular house design, such as with windows, or in differing widths, for example, and be sold as a kit to construct the walls of a house. To maintain maneuverability of the wall section by workers, a maximum width of 2.4 m (8 feet) is preferred. However, in constructions where materials are handled by a crane, greater widths, such as 9.1 m (30 feet), and even more, can advantageously be used to reduce the crane operating time for the assembly.

In the illustrated wall section 70, three wall panels have 61 cm (24 inches) in width, and an end panel 10' has a smaller width to adapt to a predetermined total width for the wall section 70. The structural members are not visible on the front face, due to the continuous facing 35 of insulating material which covers them. Only one of the structural members 24' is exposed, one one side 75 of the wall section 70. The exposed structural member 24' is designed to be covered when the wall section 70 is assembled with an adjacent wall section.

An upper wall plate 72*a* can be fastened to the upper end of each one of the wood boards 28, 30, by nails 74. Similarly, a lower wall plate 73*a*, or sill, can be fastened to the lower end of each one of the wood boards by nails (not shown). In a preferred mode, the factory-assembly of the wall section 70 is done by adding the components onto a compression table, and then compressing the components such that the insulating body of the wall panels 10 become laterally compressed between the structural members. Optionally, the upper and lower wall plates 72*a*, 73*a* can be compressed against the upper ends and the lower ends of the wall panels as well. The upper and lower wall plates 72*a*, 73*a* are then nailed with the structural members 24 while the components are in the compressed state. Then, the external compression is removed, but the insulating body 22 of the wall panels 10 tend to remain in an at least partially compressed state between the structural member due to the structural members being secured to the upper and lower wall plates 72*a*, 73*a* an maintaining the compression. The diagonals of the wall section 70 can then be measured to determine if the structural members 24 are perpendicular to the upper and lower wall plates 72*a*, 73*a*. Lack of perpendicularity can then be corrected, and a veneer can then be assembled to the front face, and nailed through the continuous facing 35 of insulating material, into the structural members 24, to lock the perpendicularity into position. This preferred mode of assembly takes advantage of the natural resilience, or elasticity, of the polystyrene which the insulating bodies 22 are made of in this particular case.

To offer greater maneuverability to the wall sections 70, an extra structural member 71 can additionally be installed during assembly of the upper and lower wall plates 72*a*, 73*a* on the side 76 of the wall section which does not have a structural member. The the extra structural member 71 can be nailed into upper wall plate 72*a* and the lower wall plate 73*a*. The secured structural member can then mimic the other structural members and help hold the body of the last wall panel 10" in place by maintaining it in a compressed state during shipping and handling, and can be removed prior to assembly of the wall section 70 on the construction site.

In alternate configurations, the two structural columns of a structural member can be provided on opposite sides of a wall section.

Figure 4:
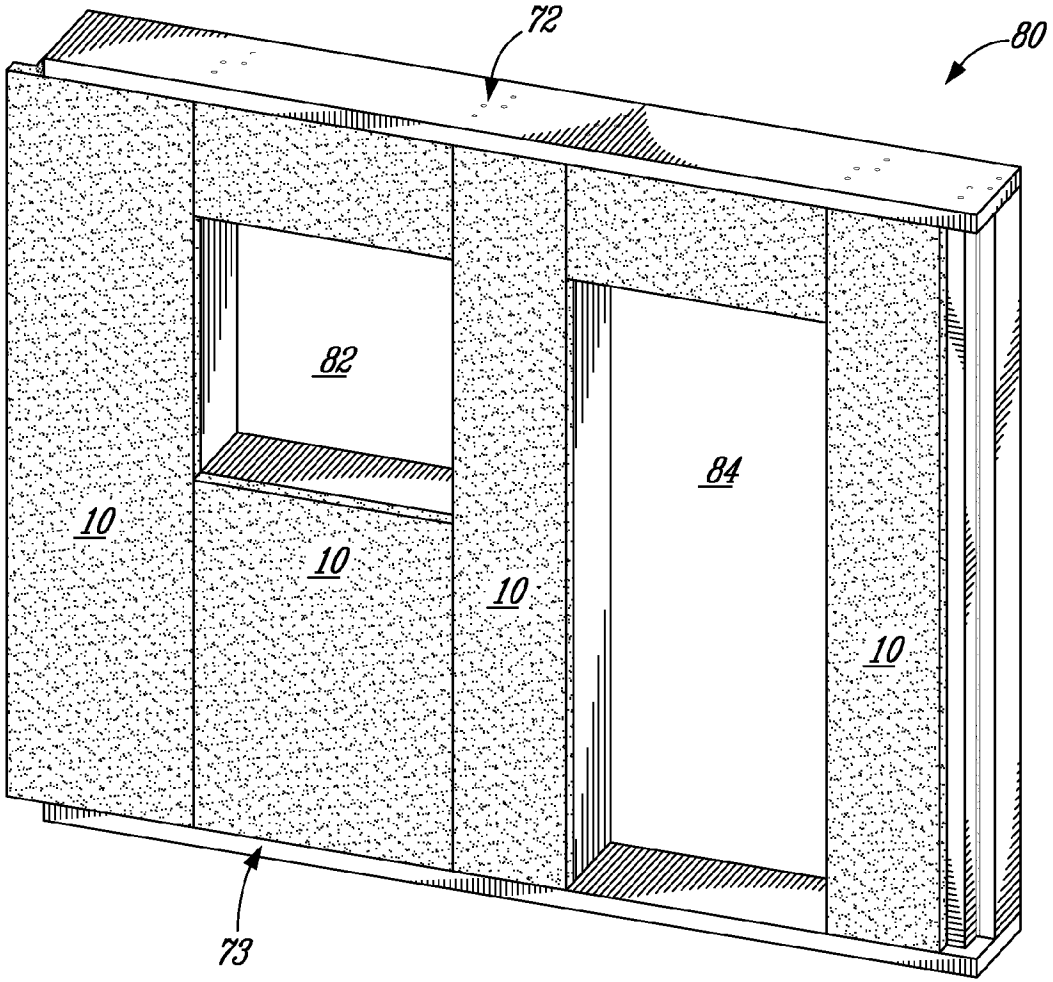
FIG. 4 is an other example of a wall section incorporating several wall panels.

FIG. 4 shows an other example of a wall section 80. In this example, the wall section also includes a plurality of wall sections 10, but the wall sections 10 have differing lengths and widths, to adapt to the predetermined particulars of the wall section 80, including a window aperture 82 and a door aperture 84 in this case. In this example, the upper frame member 72 and the lower frame member 73 cover the entire thickness of the wall section 80, including the continuous facing of insulating material.

Figure 5:
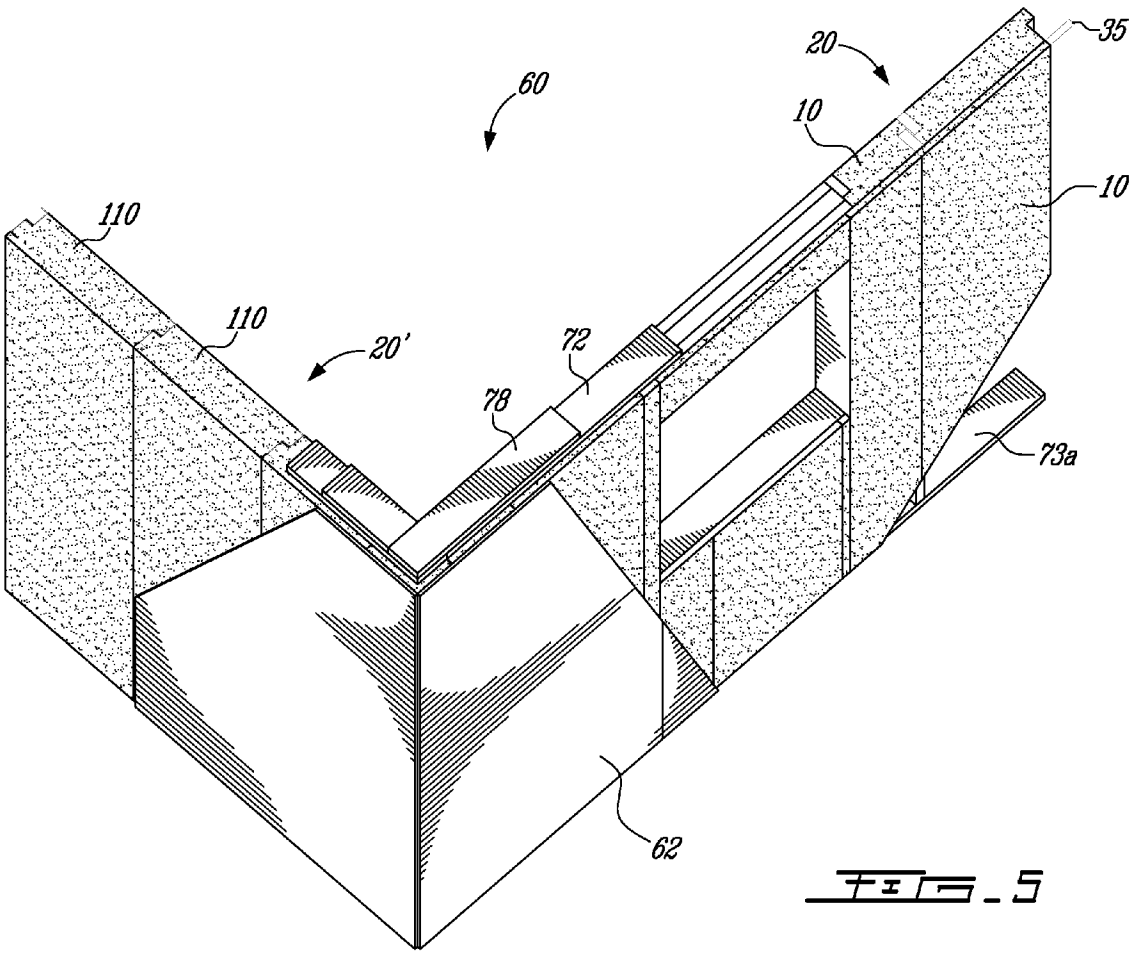
FIG. 5 is an isometric view of an example of a construction incorporating improved insulated wall panels.

FIG. 5 illustrates an exemplary wall construction 60. On the construction site, the lower wall plate 73*a* is affixed to a structure such as a subfloor. A second wall plate 78, or top wall plate can then be added onto the upper wall plates 72 of two adjacent wall sections, to link the two adjacent wall sections together. The second wall plate 78 can alternately be preassembled with a wall section. Extra components can be added to the wall section thereafter, or some can be manufactured with the wall. Such as the veneer 62 illustrated in this example.

Figure 6:
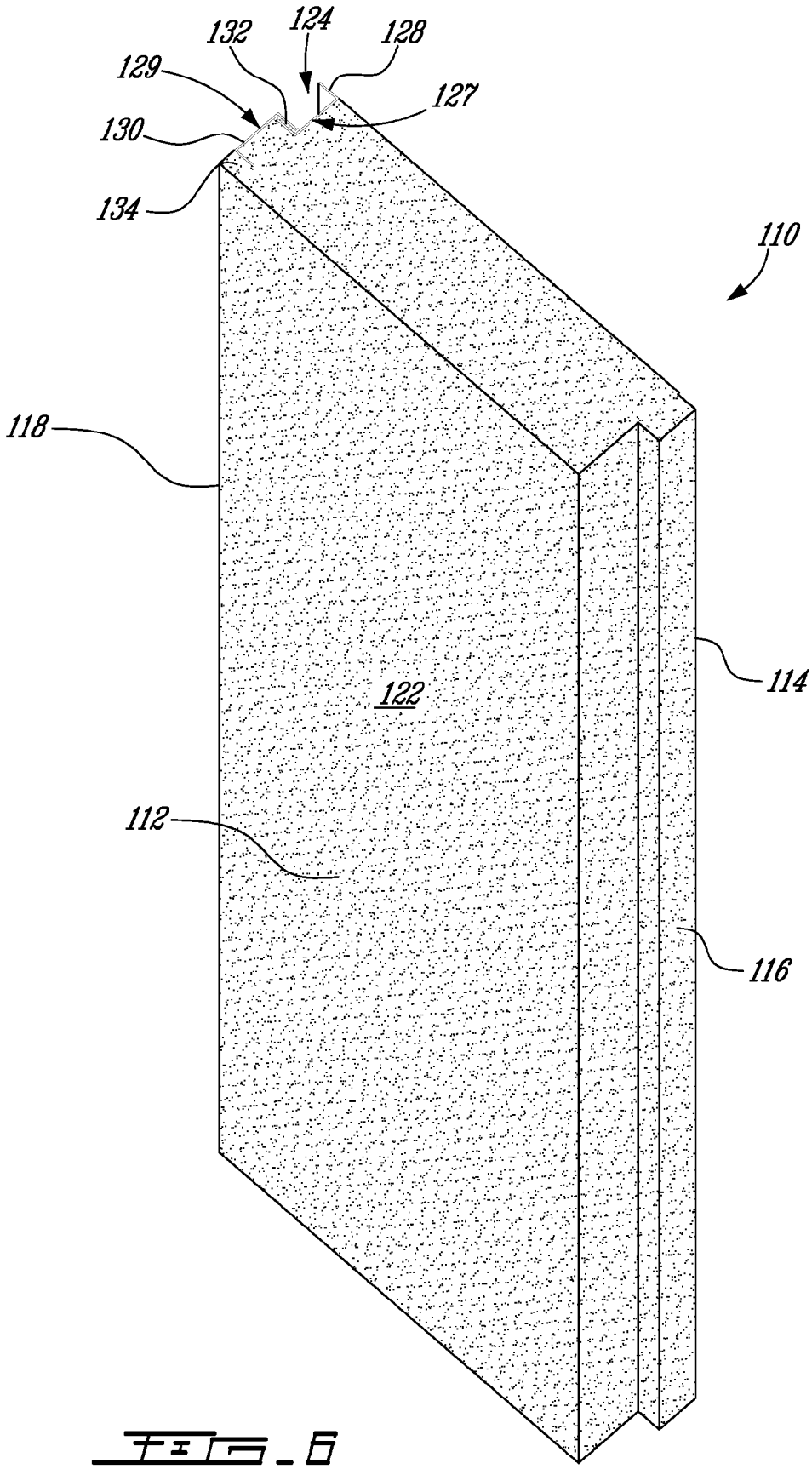
FIG. 6 is an isometric view of an example of an improved insulated wall panel where the structural member has two metal beams.
Figure 7:
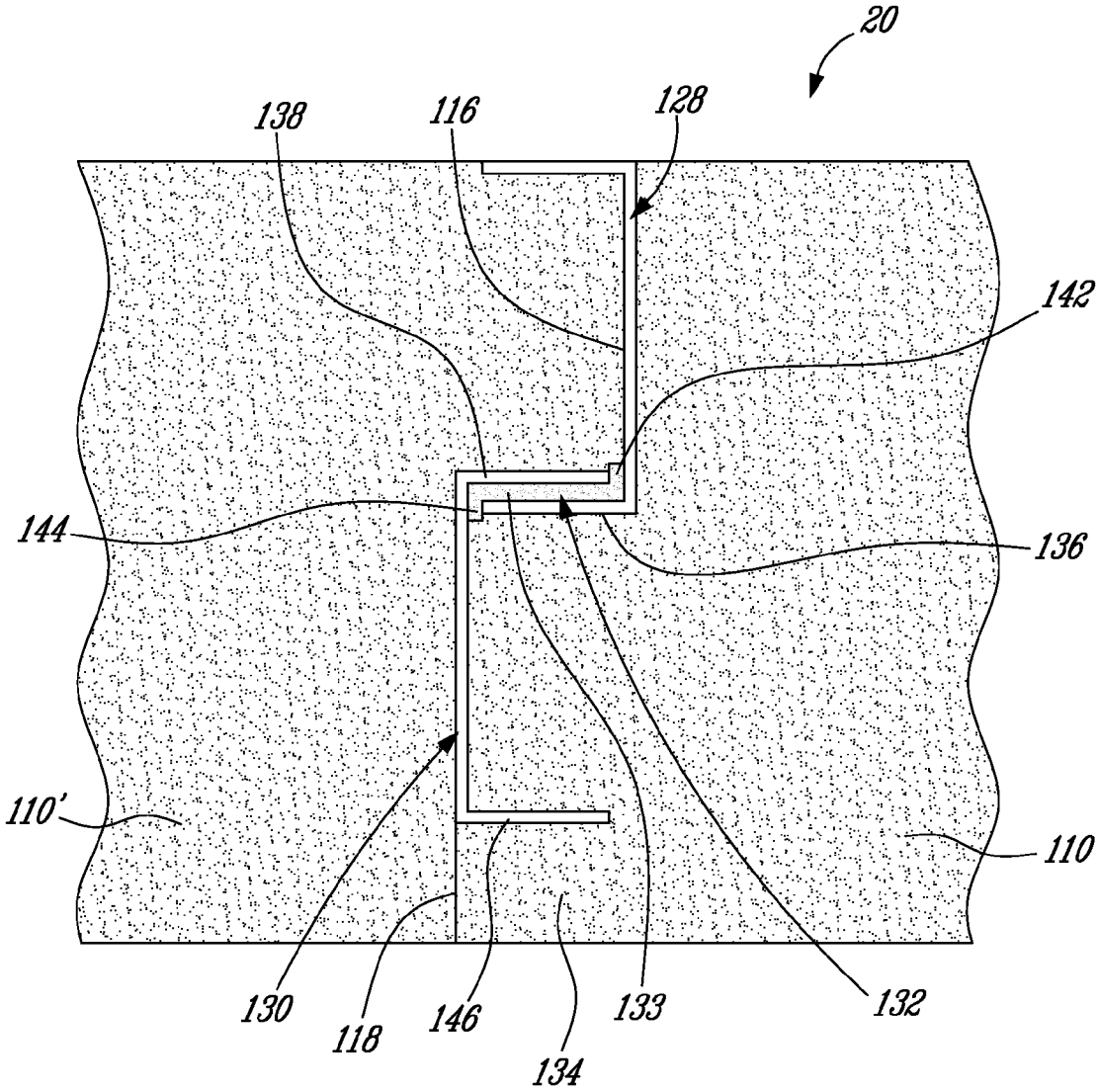
FIG. 7 is a top plan view showing two wall panels from FIG. 6 adjoined side by side.

FIGS. 6 and 7 show a second example of an insulated wall panel 110 in accordance with the improvements. This second example will be described by way of comparison with the example of FIGS. 1 and 2, for simplicity. Hence, parts associated with corresponding parts of the previous example are given corresponding reference numerals in the one-hundred series. This insulated wall panel 110 differs from the insulated wall panel 10 of FIGS. 1 and 2 in that the structural columns 127, 129, of the structural member 124, are beams 130, 132, and more particularly a rear C-shaped beam 128, and a front C-shaped beam 130, in an engaged configuration. The C-shaped beams 128, 130 are in an overlapping and staggered configuration because they are offset from one another and slightly overlap.

FIG. 7 shows a front flange 136 of the rear C-shaped beam 128 engaged within the front C-shaped beam 130 and extending against a back flange 138 of the front C-shaped beam 130. A thermal separator 133 is also used in this case. The thermal separator is an insulating component 132 sandwiched between the front flange 136 of the rear C-shaped beam 128 and the back flange 138 of the front C-shaped beam 130 and prevents contact between the front flange 136 of first C-shaped beam 128 and the back flange 136 of the second C-shaped beam 130. The insulating component 132 advantageously also has optional L-shaped ends 142, 144 to prevent contact of the flange tips with the other C-shaped beam and further increase thermal resistance. In this case, the insulating component 132 is made of an elongated strip of rubber, although many other materials having insulating characteristics can also be used, such as polystyrene or polyisocyanurate, for example. The front flange 146 of the second C-shaped beam penetrates within the body.

A metal structure is common in buildings. Metal beams offer a greater resistance to fire than wood. When metal beams are used instead of wood boards as the structural member of a wall panel, an upper metal beam and a lower metal beam can be used as an upper frame member, and a lower frame member, instead of the upper wall plate and a lower wall plate made of wood illustrated in the previous example. The upper metal beam and the lower metal beam can be secured to the structural members by welding or by fastening with nuts and bolts. In the illustrated example, the C-shaped beams are made of steel. However, other materials having satisfactory structural characteristics such as some other metals or some plastics can alternatively be used, for example.

Figure 8A:
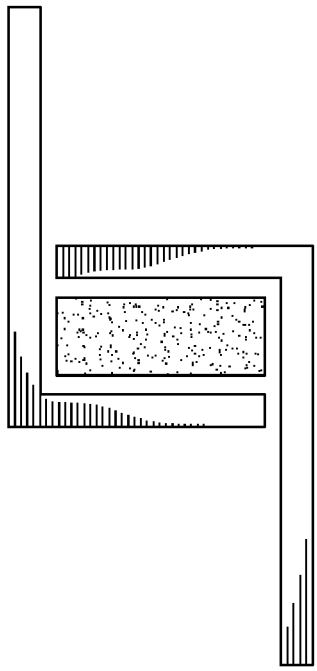
FIGS. 8A and 8B are schematic top views showing two alternate embodiments to the metal beams of FIG. 6.
Figure 8B:
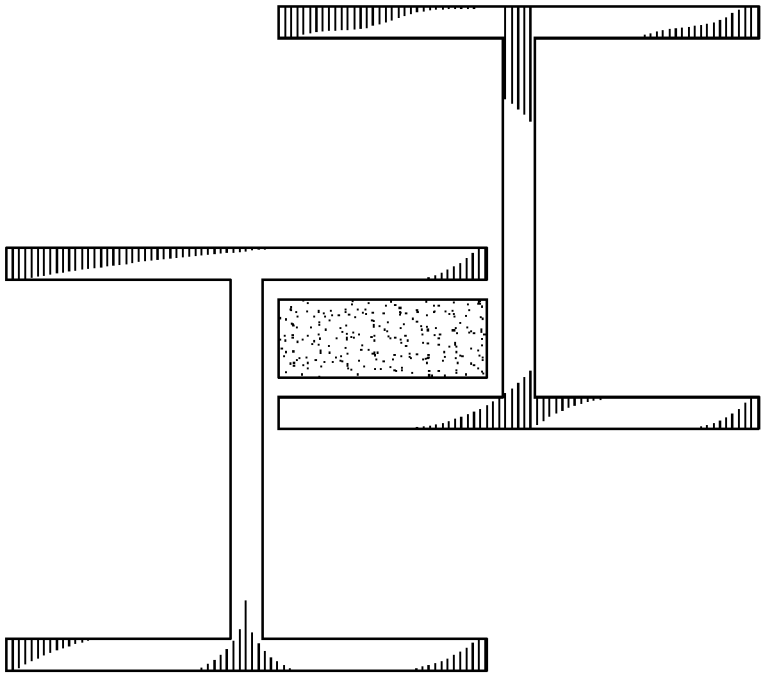

FIGS. 8A and 8B show alternate configurations of beam cross sections which can be used instead of the C-shape cross-sections of the illustrated example. FIG. 6A shows beams having a L-shape cross-section, whereas FIG. 6B shows beams having an I-shape cross-section.

Figure 9:
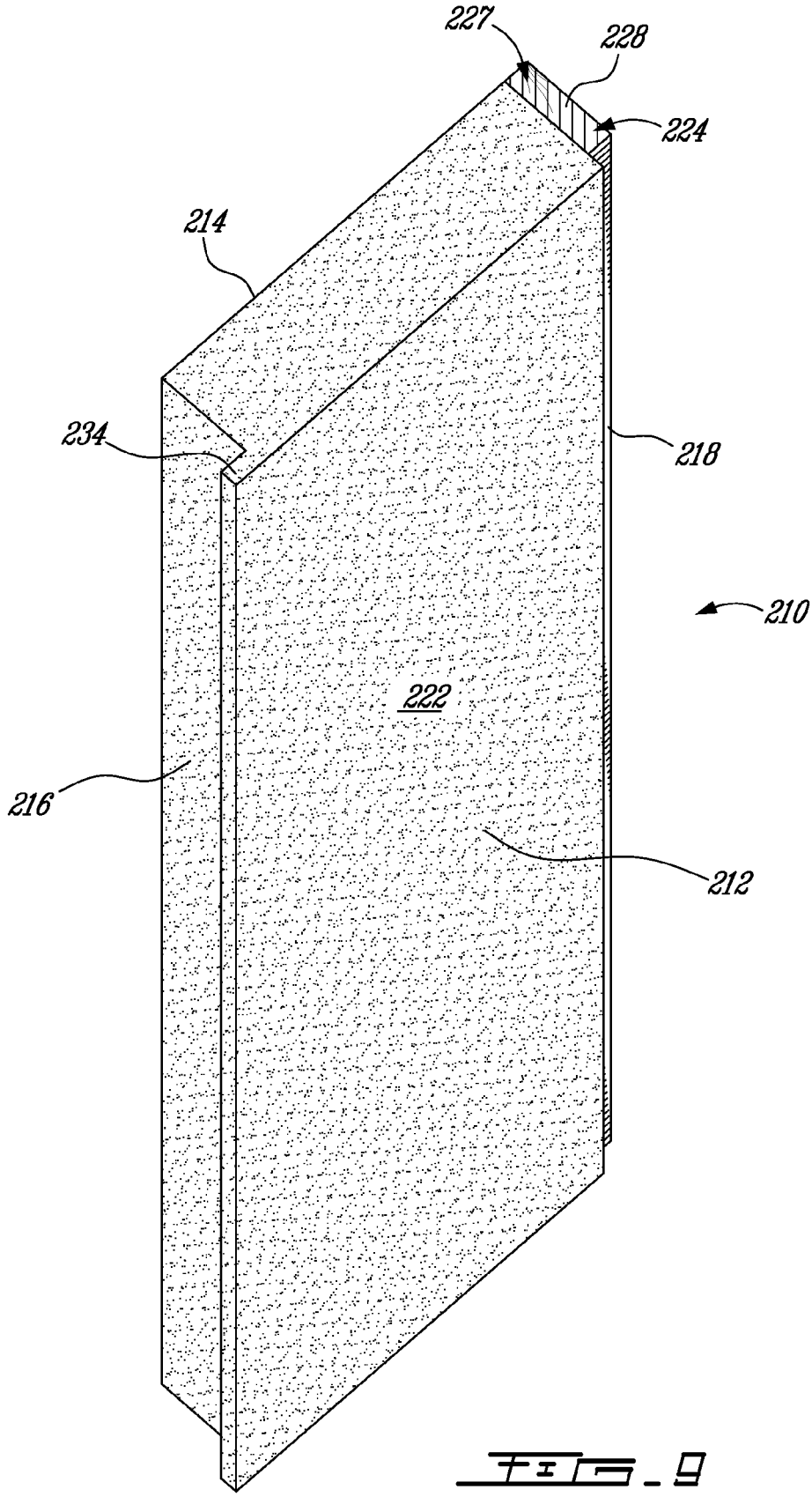
FIG. 9 is an isometric view of an example of an improved insulated wall panel where the structural member has a single wood board.

FIG. 9 shows a third example of an insulated wall panel 210 in accordance with the improvements. In this case, reference numerals in the two-hundred series are used. This insulated wall panel 210 differs from the ones described above in that the structural member 224 includes a single wood board 228.

It will be noted that various additional alternatives to the structural members described above are also possible.

As can be seen therefore, the examples described above and illustrated are intended to be exemplary only. The scope of the invention(s) is intended to be determined solely by the appended claims.

What is claimed is:

1. An insulated wall panel having an outside face, an inside face, and two opposite mating sides, each mating side being shaped to mate with the opposite mating side of another insulated wall panel for mating assembly in a wall section, the insulated wall panel comprising a structural member extending along one of the mating sides and being offset from the outside face, the structural member includes two structural columns both oriented transversally between the outside face and the inside face and arranged in an overlapping staggered configuration, and a thermal separator provided between the structural columns, and a self-supporting body of insulating material in which the structural column adjacent the outside face is nested, having an extension forming the thermal separator, and having an integral covering extension extending laterally at the outside face, the self-supporting body of insulating material, including the covering extension, spanning the entire outside face to form a continuous and flush facing thickness of insulating material covering the structural members when two or more adjacent wall panels are matingly adjoined into a wall section.

2. The insulated wall panel of claim 1 wherein the structural columns are wood boards.

3. The insulated wall panel of claim 2 wherein the wood boards overlap along a transversal overlap distance, further comprising a layer of insulating material between the wood boards and extending transversally along the overlap distance.

4. The insulated wall panel of claim 1 wherein the structural columns are a rear metal beam having a front flange, and a front metal beam having a rear flange, the front flange is engaged with the rear flange, and an insulating component is sandwiched between the front flange and the rear flange.

5. A wall section comprising: a plurality of adjacent insulated wall panels, each wall panel having an outside face, an inside face, two opposite mating sides, a structural member, having an upper end and a lower end, extending along one of the mating sides, offset from the outside face, the structural member including two structural columns both oriented transversally between the outside face and the inside face and arranged in an overlapping staggered configuration, and a thermal separator provided between the structural columns, and a body of insulating material in which the structural column adjacent the outside face is nested, having an extension forming the thermal separator, and having a structural member covering extension on the outside face, the insulated wall panels being aligned side by side with a mating side of each wall panel engaged with a corresponding mating side of an adjacent one of the wall panels and the structural member covering extensions covering the structural member in a continuous and flush facing layer of insulating material, and an upper frame member secured to the upper end of each structural member and a lower frame member secured to the lower end of each structural member.

6. The wall section of claim 5 wherein the bodies of insulating material of the wall panels are in a compressed state between the structural members.

7. The wall section of claim 5 wherein the structural columns are wood boards.

8. The wall section of claim 7 wherein the wood boards overlap along a transversal overlap distance, further comprising a layer of insulating material between the wood boards extending transversally along the overlap distance.

9. The wall section of claim 5 wherein the structural columns are a rear metal beam having a front flange, and a front metal beam having a rear flange, the front flange is engaged with the rear flange, and an insulating component is sandwiched between the front flange and the rear flange.

* * * * *